US006475339B1

(12) United States Patent
Chai et al.

(10) Patent No.: US 6,475,339 B1
(45) Date of Patent: Nov. 5, 2002

(54) METHOD FOR RAPIDLY DETERMINING A PULP KAPPA NUMBER USING SPECTROPHOTOMETRY

(75) Inventors: Xin-Sheng Chai, Atlanta; Jun Yong Zhu, Marietta, both of GA (US)

(73) Assignee: Institute of Paper Science and Technology, Inc, Atlanta, GA (US)

( * ) Notice: Subject to any disclaimer, the term of this patent is extended or adjusted under 35 U.S.C. 154(b) by 0 days.

(21) Appl. No.: 09/586,324

(22) Filed: Jun. 2, 2000

Related U.S. Application Data

(60) Provisional application No. 60/137,366, filed on Jun. 3, 1999.

(51) Int. Cl.[7] ..... D21C 7/12; G01N 21/25

(52) U.S. Cl. ..... 162/49; 356/326; 356/425

(58) Field of Search ..... 162/49, 79; 356/317, 356/326, 318, 73, 425; 250/461.1, 458.1, 459.1, 390.07, 390.08

(56) References Cited

U.S. PATENT DOCUMENTS 4,837,446 A 6/1989 Renard et al. ..... 250/461.1

OTHER PUBLICATIONS

E. Kibulnieks et al., "The STFI OPTI–Kappa Analyzer Applications and Accuracy," *TAPPI J.,* Nov. 1987, 70(11), pp. 38–42.

A. Michell, "Kappa Number Determination in Kraft Pulping by FTIR Spectroscopic Measurements on Spent Liquors," *TAPPI J.,* Apr. 1990, 73(4), pp. 235–236.

J. Li et al., "On the Structural Significance of Kappa Number Measurement," *Nordic Pulp and Paper Research J.,* Feb. 1988, vol. 13(2), pp. 153–158.

J. Li et al., "Kinetics and Mechanism of Kappa Number Determination," *Nordic Pulp and Paper Research J.,* Feb. 1998, vol. 13(2), pp. 147–152.

A. Plonka et al., "Determination of Total Lignin Content in Fibrous Materials," *Zellstoff Papier,* Nov. 1974, 23(11) pp. 327–332.

*Primary Examiner*—Steve Alvo
(74) *Attorney, Agent, or Firm*—Veda V. Christmas, Esq.

(57) ABSTRACT

A system and method for rapidly determining the pulp kappa number through direct measurement of the potassium permanganate concentration in a pulp-permanganate solution using spectrophotometry. Specifically, the present invention uses strong acidification to carry out the pulp-permanganate oxidation reaction in the pulp-permanganate solution to prevent the precipitation of manganese dioxide ($MnO_2$). Consequently, spectral interference from the precipitated $MnO_2$ is eliminated and the oxidation reaction becomes dominant. The spectral intensity of the oxidation reaction is then analyzed to determine the pulp kappa number.

13 Claims, 3 Drawing Sheets

METHOD FOR RAPIDLY DETERMINING A PULP KAPPA NUMBER USING SPECTROPHOTOMETRY

CROSS REFERENCE TO RELATED APPLICATIONS

This application claims the benefit of U.S. Provisional Application Serial No. 60/137,366, filed Jun. 3, 1999, which is incorporated herein by reference.

GOVERNMENT INTEREST

This invention was made with Government support under Contract No. DE-FC07-96ID13438, awarded by the Department of Energy. The Government has certain rights in this Invention.

TECHNICAL FIELD

The present invention relates generally to determining a kappa number of various wood pulps, and more particularly, relates to a system for rapidly determining the pulp kappa number of a pulp sample using a spectrophotometric detector.

BACKGROUND OF THE INVENTION

The kappa number of pulp is an important parameter in pulp manufacturing. It is used for indirectly indicating lignin content, relative hardness, and bleachability of pulp. Once the kappa number is known, the amount of bleaching agent needed for achieving a desired pulp brightness can then be ascertained. The pulp kappa number can be determined by the volume of 0.02 mole/liter (0.1N) potassium permanganate ($KMnO_4$) solution consumed through an oxidation reaction by 1 gram of moisture-free or oven dry (O.D.) pulp in an acidic medium, where potassium permanganate, also referred to herein simply as permanganate, is a strong oxidation agent.

Presently, the titration method is a universally known and commonly used method for measuring the kappa number of various pulps. This titration method is described in tappi Test Methods—T236 cm-85, Tappi Press, 1996, which is incorporated herein by reference, and was first proposed in 1934 by Wiler, Paper Trade Journal, 98(11), 1934, and was later developed in the 1950s based on the work of Watson and Stamp, J. Aust. Pulp Paper Ind. Tech. Assoc., 11(1), 1957, Valeur and Torngren, Svensk Papperstidning, 30(22), 1957, and Tasman and Berzins, Tappi J., 40(9), 1957. Using the titration method, the pulp kappa number is calculated using the difference between the initial volume of potassium permanganate blank solution and the final volume of potassium permanganate remaining after the oxidation of lignin in the pulp-permanganate solution. It is known in the art that potassium permanganate blank solution is simply potassium permanganate solution without pulp.

The final volume is determined by titration to determine how much unconsumed potassium permanganate remains after a predetermined time period. In accordance with the method, the final volume is measured after ten minutes, thereby presuming that the oxidation of lignin in a fiber or pulp sample is complete after that time. Also, the titration method is performed wherein the pulp-permanganate solution temperature is maintained at 25° C. and under an initial $H^+$ concentration of 0.4 mol/L, or pH of about 0.4, acidic conditions,. The following reactions generally occur as a result of such acidic conditions:

$$MnO_4^- + 8H^+ + 5e \xrightarrow{E^0=+1.51V} Mn^{2+} + 4H_2O \quad (1a)$$

$$MnO_4^- + 4H^+ + 3e \xrightarrow{E^0=+1.69V} MnO_2 + 2H_2O \quad (1b)$$

where (1a) produces manganese ions, $Mn^{2+}$, and (1b) produces manganese dioxide precipitation, $MnO_2$. Finally, the titration method requires that the consumed potassium permanganate volume is approximately 50% of the initial volume after a ten-minute reaction in order to obtain a valid measurement. Such a requirement is difficult to reconcile because the excess permanganate volume is known only after the kappa number is determined.

Under the titration method, a number of assumptions are made which can be problematic, and therefore, may lead to an inaccurate and inconsistent determination of the pulp kappa number. First, it is assumed that all of the lignin in pulp has reacted with the permanganate in the ten-minute time period. In fact, potassium permanganate can also be consumed by decomposition by other organic materials in pulp. Consequently, the final volume of potassium permanganate in the pulp-permanganate solution would not be a reflection of the excess potassium permanganate remaining after oxidation of lignin alone. Therefore, the difference between volumes calculated as the kappa number would be inaccurate.

Secondly, it is assumed that the oxidation reaction is completed in ten minutes. This oxidation reaction time is seemingly arbitrary in light of the fact that actual oxidation reaction times vary from pulp to pulp. Also, the oxidation reaction time is dependent on the mass of the pulp sample, thereby producing inconsistencies in kappa number.

Another assumption is that the effect of the variation in excess permanganate volume is insignificant. Due to its insignificance, the titration method attempts to correct this effect by a non-constant correction factor as tabulated in the Tappi test method. However, the non-constant correction factor is purely empirical through experimental calibration, and therefore, can lead to errors in determining the pulp kappa number.

Besides the problems that can arise due to the foregoing assumptions, the titration method itself is very tedious, time-consuming, and prone to error due to the human element. Titration is performed manually, and as a consequence, titration is very dependent upon the skill of an operator. It also takes about thirty minutes for an operator to complete the tedious titration process. For instance, pulp kappa numbers for the same pulp sample can also vary widely from one operator to the next operator.

Spectrophotometry is another technique that has been attempted to determine the pulp kappa number as described in articles entitled "Kappa Number Determination in Kraft Pulping by FTIR Spectroscopic Measurements on Spent Liquors", Tappi J., 74(4):235 (1990), by A. J. Michell, "Determination of Total Lignin Content in Fibrous Materials," Zellstoff Papier, 23(11):327 (1974), by A. M. Plonka et al., and "The STFI OPTI-Kappa Analyzer: Applications and Accuracy," Tappi J., 70(11):38 (1987), by Kibulnieks et al., which are all incorporated herein by reference in their entireties. Spectrophotometry can provide direct and instantaneous measurements of chemicals in reactions by measuring the absorbance or transmittance of light from chemicals using an optical instrument commonly known as a spectrophotometer.

These methods described in the prior art are capable of ascertaining the lignin content of a pulp sample, but not the lignin reactivity, which can be used to determine the amount of chemicals required in the bleaching process. Consequently, these methods are limited in that they cannot directly ascertain the pulp kappa number, and therefore, use a pre-calibrated linear relationship between the lignin content in pulp and the pulp sample kappa number measured by the traditional titration method. The calibration relationship varies from pulp to pulp due to the variation of lignin reactivity with wood species.

Li and Gellerstedt, Nordic Pulp & Paper Research J., 13(2):147, 1998, reported the results of a study on the kinetics and mechanism of pulp-permanganate oxidation reaction under the conditions suggested in standard kappa testing methods. In the study, the permanganate in pulp-permanganate solutions was directly measured using UV/Vis spectrophotometry under conditions suggested in common kappa number test methods, such as TAPPI Test Method—T236cm-85 and SCAN-C1 Test Method. According to Li and Gellerstedt, the dominant reaction is an overall conversion of permanganate to $MnO_2$ precipitation according to reaction (1b). It was found that the precipitated $MnO_2$ strongly interfered with the measured absorption spectrum of the pulp-reacting solution and caused significant measurement difficulties in determining the excess permanganate in the final pulp-reacting solution. It was impossible to obtain meaningful kappa numbers that agree with the kappa numbers obtained by standard titration based methods as they indicated in their work. Nevertheless, they concluded that direct spectrophotometry can be used to calculate the kappa number determination from their experimental data.

One problem with using their proposed method is since it is difficult to determine the amount of precipitated $MnO_2$, the amount of permanganate consumed by pulp-permanganate oxidation reactions cannot be quantified for pulp kappa number calculations. In addition, considering the formation of $MnO_2$ precipitation, one skilled in the art cannot use spectrophotometry to determine pulp kappa number due to suspended $MnO_2$ particles producing spectral interference. Consequently, the spectral interference from the precipitated $MnO_2$ typically causes errors in determining the pulp kappa number using spectrophotometry. This result cannot be ignored or eliminated. Hence, the Li and Gellerstedt conclusion cannot be supported by the reaction conditions described in the study, and the study does not describe or suggest how the kappa number may be directly measured using spectrophotometry.

Therefore, there is a need for an improved system and method for determining the pulp kappa number of a pulp sample. There is also a need for a system and method that determines the pulp kappa number accurately and consistently. In addition, there is a need for a system and method for determining the pulp kappa number for a pulp sample which is not operator dependent. There is a further need for a system and method for rapidly determining the pulp kappa number through direct measurements of a pulp sample. There is yet another need for a system and method for directly determining the pulp kappa number without the need for calibration or correction.

SUMMARY OF THE INVENTION

The present invention solves the above-described needs by providing a system and method for rapidly determining the pulp kappa number through direct measurement of the potassium permanganate concentration in a pulp-permanganate solution using spectrophotometry. Specifically, the present invention uses strong acidification to carry out the pulp-permanganate oxidation reaction in the pulp-permanganate solution to prevent the precipitation of manganese dioxide ($MnO_2$). Consequently, spectral interference from the precipitated $MnO_2$ is eliminated and the oxidation reaction (1a) becomes dominant. The spectral intensity of the oxidation reaction, also referred to herein as pulp-permanganate oxidation reaction, is then analyzed to determine the pulp kappa number. The term "pulp-permanganate solution" is also referred to herein as pulp-potassium permanganate solution.

In addition, the present invention provides a method of accurately determining the pulp-permanganate oxidation reaction time and the final excess volume of potassium permanganate ($KMnO_4$) in the pulp-permanganate solution from the measured permanganate absorption spectral intensities. Furthermore, due to the use of strong acidic conditions of the potassium permanganate solution, where the initial $H^+$ concentration preferably greater than 3 mol/L, the present invention eliminates the effect of the final volume of excess potassium permanganate and the mass of the pulp, or pulp sample, on accurately determining the kappa number. Advantageously, the present invention then can be used to rapidly and directly determine pulp kappa numbers of various pulp samples using permanganate absorption data without the need for calibration and corrections. Finally, the present invention eliminates the element of human error common to prior methods for measuring kappa number.

One aspect of the present invention provides a method for determining a pulp kappa number for a pulp sample, comprising the steps of: mixing continuously a pulp-reacting solution, said pulp-reacting solution comprising: 1) a predetermined amount of pulp containing fibers and 2) a predetermined amount of reacting solution, said reacting solution having strong acidification and including an oxidation agent, where mixing the pulp-reacting solution causes an oxidation reaction in the pulp-reacting solution; filtering the pulp-reacting solution to limit fiber flow; subjecting at least a segment of the fiber filtered pulp-reacting solution to light, wherein the light is partially absorbed by the oxidation agent in the pulp-reacting solution; generating a time-dependent absorption spectral intensity from the absorption of the light by the oxidation agent in the pulp-reacting solution; collecting the time-dependent absorption spectral intensity by a absorption spectrographic method to determine an absorption spectral intensity for the oxidation agent; analyzing the time-dependent absorption spectral intensity using an oxidation reaction kinetic analysis to determine an oxidation reaction end point; and calculating a pulp kappa number for the pulp sample based on the predetermined amount of pulp, the predetermined amount of reacting solution, the absorption spectral intensity of the oxidation agent before the oxidation reaction, and the absorption spectral intensity of the oxidation agent at the oxidation reaction end point.

In accordance with this aspect of the present invention, the pulp-reacting solution may be subjected to light by an optical flow cell or a fiber optic probe, each being capable of transmitting and/or redirecting visible light. The predetermined amount of pulp ranges from about 0.05 to 1000 grams depending on the size of the reacting solution.

The reacting solution having strong acidification preferably contains sulfuric acid, where the sulfuric acid has a concentration level sufficient to prevent a significant amount of $MnO_2$ from being precipitated during the oxidation reaction. Specifically, the reacting solution comprises the oxidation agent being 0.02 mol/L potassium permanganate solution and the strong acidification being 2.0 mol/L sulphuric acid, where the volume ratio of 0.02 mol/L potassium permanganate solution and 2.0 mol/L sulphuric acid is 1:4. Furthermore, the resulting sulfuric acid concentration in the pulp-reacting solution is preferably about 1.6 mol/L.

In addition, the strong acidification of the reacting solution can have an initial $H^+$ concentration in the range of about 3.0 mol/L to 10 mol/L so long as it does not degrade the pulp fibers in the pulp-reacting solution.

The absorption spectroscopic method can use either the absorption spectral intensity of the oxidation agent at any selected wavelength between 450–600 nm or integrated over the entire absorption range of 450–600 nm.

After the spectral intensities have been obtained, the kappa number can be determined by calculating the kappa number based on the equation, $$K = \frac{a}{w}\left(1 - \frac{A_e}{A_0}\right),$$

where K is the kappa number, a is the predetermined amount of reacting solution having strong acidification, w is the predetermined amount of pulp, $A_0$ is the oxidation agent absorption before the oxidation reaction occurs, and $A_e$ is the oxidation agent absorption spectral intensity at the oxidation reaction end point. $A_0$ can be determined by obtaining the oxidation agent absorption in the reacting solution before mixing the pulp and the reacting solution together.

Both $A_0$ and $A_e$ can be the absorption spectral intensities at a single wavelength, for example at 546 nm, or integrated over the entire permanganate absorption spectrum (450–600 nm). In the case of using the integrated spectral intensities, a simple photo detector is sufficient to conduct kappa measurement using the present invention instead of using a spectrometer.

In yet another aspect of the present invention, a system is provided for determining permanganate absorption spectral intensities in a pulp-permanganate solution, comprising: a spectrometer for separating and detecting absorption spectral data of the pulp-potassium permanganate solution based on wavelengths; a light transmitting device connected to the spectrometer, wherein the light transmitting device provides absorption data of the pulp-permanganate solution to the spectrometer, said absorption data being between 450 and 600 nm; a filter for filtering the pulp-potassium permanganate solution before the light transmitting device provides the absorption data of the pulp-permanganate solution to the spectrometer, a light source connected to the light transmitting device, wherein the light source provides light to the pulp-potassium permanganate solution for absorption; and a computer system connected to the spectrometer, the computer system containing software program for collecting, displaying, and analyzing the absorption data of the pulp-potassium permanganate solution.

In connection with this aspect, the light transmitting device can be either a flow cell or a fiber optic probe for transmitting and/or redirecting visible light. In the case of using a flow cell, a pump is connected to the flow cell so as to provide flow of the pulp-potassium permanganate to the flow cell.

These and other objects, features, and advantages of the present invention may be more clearly understood and appreciated from a review of the following detailed description of the disclosed embodiments and by reference to the appended drawings and claims.

DETAILED DESCRIPTION

The present invention is directed to a system and method for rapidly and directly determining the pulp kappa number of a pulp sample using spectrophotometry. The device used in this method is inexpensive and easy to implement. The system measures the absorption of permanganate in a reacting solution containing a pulp sample and permanganate using a spectrophotometer to determine the pulp kappa number of the pulp sample.

Now turning to FIGS. 1–6, the system and method for determining the kappa number of a pulp sample using spectrophotometry is described, wherein like elements are represented by like numerals throughout the several figures.

Figure 1:
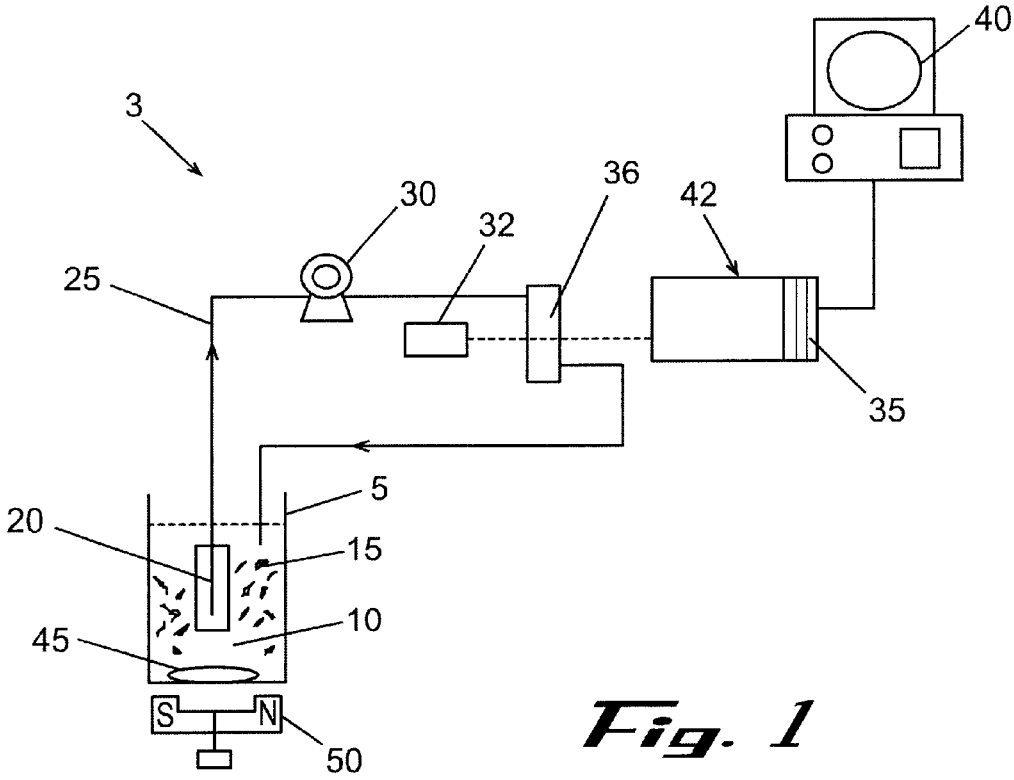
FIG. 1 illustrates a system for obtaining the spectral intensity of a pulp sample in accordance with an exemplary embodiment of the present invention.

FIG. 1 illustrates one preferred embodiment of the inventive system, where the system 3 includes a spectrophotometer 42 and 40 (spectrometer 42 and computer 40), a flow cell 36 and light source 32, a feed line 25 and peristaltic pump 30, and a filter 20. The feed line 25 and peristaltic pump 30 periodically or continuously withdraws a pulp-reacting solution 10 that has been strongly mixed or stirred from a container 5, such as a standard beaker. Mixing or stirring occurs typically using a stirring bar 45 and magnetic stirring meter, but any other conventional method for mixing the solution commonly known in the art can be applied for the present invention. The feed line 25 consists generally of tubing and connectors and is typically made of stainless steel, copper, or nylon for solutions maintained at room temperature. However, the present invention may use any standard feed line commonly known in the art.

In FIG. 1, the feed line 25 can be connected to a filter 20. Preferably, the filter 20 is placed in the pulp-reacting solution 10 to limit the fiber flow of the pulp 15 in the pulp-reacting solution 10 into the feed line 25. The filter can be a net filter of about 200 mesh, preferably made of stainless steel. However, it is understood by one skilled in the art that a filter of any material can be used as long as the material does not react with process chemical in the present system. Furthermore, it is understood that the filter may be any size suitable for limiting the flow of pulp fibers into the feed line.

The pump 30 draws a small filtered sample stream from the pulp-reacting solution 10 at some constant flow rate, which depends upon the pulp-reacting solution size. The pump 30 facilitates the flow of the pulp-reacting solution 10, such as a pulp-potassium permanganate solution, through the feed line 25. The pulp-reacting solution 10 is re-circulated by the pump 30 such that a constant flow rate is achieved. For example, a typical flow rate can be about 100 mL/min.

The pulp-reacting solution 10 passes through the filter 20 filtering out fibers from the solution before it enters an optical flow cell 36. The flow cell 36 circulates the solution 10 in and out of the light source path. The flow cell preferably has an optical path length of about 1 mm. The path length is the depth of the light passing through an absorbing medium, which in this case, is the thickness of the flow cell. This path length is very important because it is a determinant of the signal to noise ratio in the inventive system. For example, if the path length is too long (thick), too much absorption occurs and not enough light is seen by a detector, such as a photometric array detector 35. On the other hand, if the path length is too short (thin), not enough absorption occurs, or rather, the detector does not see enough of the real signal due to absorption on top of the base light intensity, despite the fact that there is a lot of light passing through to the detector.

A flow cell suitable for use in the claimed invention include commonly recognized flows cells which are transparent to light. Preferably flow cells manufactured by Hewlett-Packard, Inc. (now Agilent Technologies) of Palo Alto, Calif. are used in this claimed system.

It will be appreciated by one skilled in the art that the pulp-reacting solution may be caused to flow through the flow cell using any art recognized method. Preferred methods include those that create a pressure drop thereby drawing the sample through the flow cell. Such systems may include, for example, a pump or vacuum.

Referring still to FIG. 1, the optical flow cell 36 is connected to a spectrometer 42 having a photometric array detector 35 contained therein. The spectrometer 42 may be an ultraviolet/visible spectrometer. In the present invention, only the visible portion of the spectrum is of interest and therefore, a spectrometer or other detector capable of capturing at least the visible spectrum can be utilized. The spectrometer 42 separates the absorption lights according to the wavelength of the light. The photodiode array detector 35 then detects the absorption light at different wavelengths to obtain the absorption in an entire spectrum (a range of wavelength).

It is understood by one skilled in the art that a spectrometer usually includes a photodiode array detector, and further that a spectrophotometer refers to a system that includes the spectrometer and a data acquisition system, such as a computer 40 including a display unit with spectral data acquisition and data processing software.

Light from a UV/Vis light source 32, preferably a tungsten lamp, located within the spectrophotometer 42 passes through the flow cell 36 where some light is absorbed by the fiber filtered pulp-reacting solution 10. The light leaves the flow cell 36 where it is returned to the spectrometer 42 for measurement. The spectrometer 42 detects a UV/Vis absorption of the pulp-reacting solution over a specific range of wavelength, preferably 450–600 nm, which is recorded by a computer 40.

The computer 40 can record the absorption at a speed of about one spectrum per second. This process continues throughout the oxidation reaction of the pulp-reacting solution such that multiple readings can be taken during the reaction. The recorded time-dependent absorption spectra can be viewed by the spectrophotometer software and analyzed to obtain the end point of the oxidation reaction for determining kappa number using the inventive method described herein below.

In the present invention, potassium permanganate absorption is detected from the pulp-reacting solution. Due to the fact that permanganate only absorbs in the visible range, i.e. around 546 nm, the data collected in only the visible range of 450–600 nm is necessary for application of the present invention.

The pulp-reacting solution 10 in the container 5 is a reacting solution mixed with oven-dried or wet pulp 15, where the reacting solution consists mainly of water, potassium permanganate, and sulphuric acid. The reacting solution is also referred to herein specifically as potassium permanganate solution or permanganate solution with sulfuric acid, which is further described in greater detail herein below. Furthermore, the pulp-reacting solution is also referred to herein specifically as pulp-permanganate solution, which is the mixture of the pulp sample, potassium permanganate, and sulfuric acid solution.

The pulp-permanganate solution 10 is strongly and continuously stirred or mixed using a stirring bar 45 and a magnetic stirring meter 50, which is commonly used in the art as previously mentioned. In the present invention, the pulp-permanganate solution 10 is a strong acidic solution with $H^+$ concentration greater than 3.0 mol/L, preferably in a range greater than 3.0 mol/L and less than 10.0 mol/L, and more preferably 3.2 mol/L. $H^+$ concentrations should be strong enough to limit the production of precipitated $MnO_2$, but not so strong as to degrade the pulp fibers. Due to the strong acidic conditions, upon mixing the pulp-permanganate solution only the desired oxidation reaction occurs, and there is no precipitated $MnO_2$. This oxidation reaction is also referred to herein as pulp-permanganate oxidation reaction.

While FIG. 1 illustrates a preferred configuration for circulating the pulp-permanganate solution through the optical flow cell to detect permanganate absorption, any system which allows one skilled in the art to take absorption measurements in liquids is suitable for use in the claimed invention. One of ordinary skill in the art would also recognize a variety of known techniques for causing the pulp-reacting solution to flow through the flow cell through the use of a pressure drop. A preferred UV/Vis spectrophotometer for use in the present invention is UV-8453 manufactured and sold by Hewlett-Packard (now Agilent Technologies) of Palo Alto, Calif; however, any art recognized spectrophotometer or any absorption measurement instrument can be used in the present invention.

Figure 2:
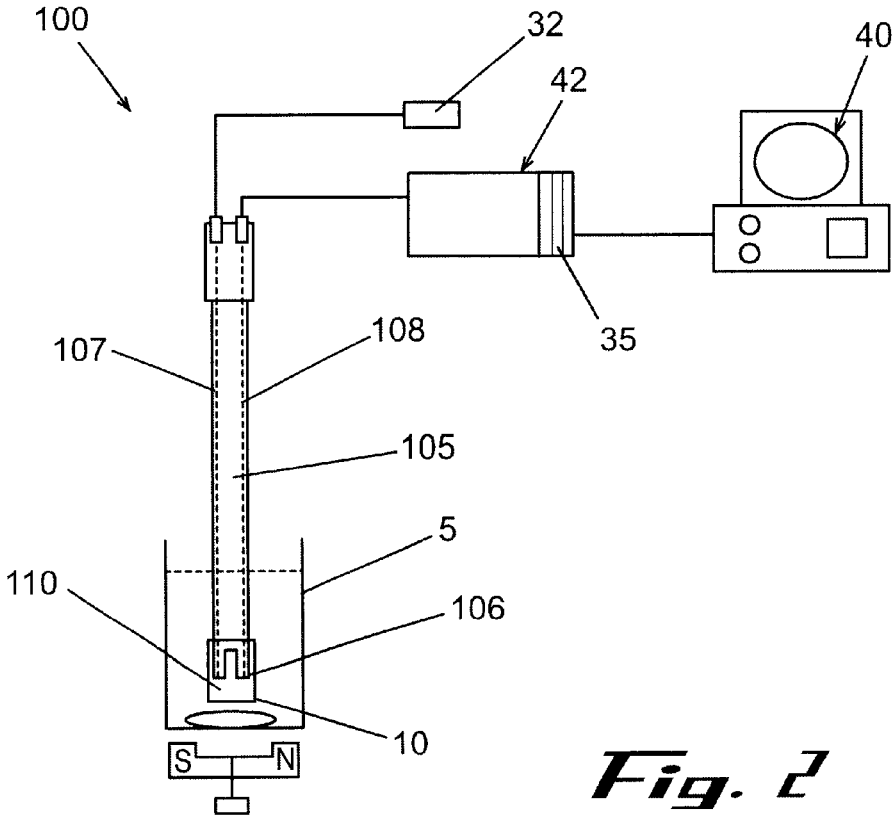
FIG. 2 illustrates a hand-held system for obtaining the spectral intensity of a pulp sample consistent with an embodiment of the present invention.

Now turning to FIG. 2, another embodiment consistent with the present invention is illustrated. The system 100 is an embodiment that can be hand-held using a fiber optic probe 105, which is known and commonly used in the art for transmitting light. Unlike the system of FIG. 1, this embodiment does not include a feed line, pump, and flow cell. Instead, the system replaces those elements with the fiber optic probe 105, which can be simply inserted into a pulp-permanganate solution 10 in the container 5 for kappa number measurements. Preferably, the fiber optic probe used in the present is a T300-RT-UV/VIS Transmission Dip Probe manufactured and distributed by Ocean Optics, Inc. of Dunedin, Fla.

The fiber optic probe 105 transmits light from the light source 32 through a fiber optic cable 107. At the bottom of the fiber optic probe, known as a sensor 106, there is a fiber filter cap 110 to allow the pulp-permanganate solution flow into the sensor 106 and to limit the fiber flow into the sensor. The probe 105 uses reflection or refraction of light to direct light in and redirect light out of the solution. Specifically, a first GRIN lens (not shown) for collimation and a first mirror or prism (not shown) within the sensor 106 directs the light out the fiber optic cable 107 into the reacting solution or pulp-reacting solution. A second mirror or prism (not shown) redirects the light transmitted through the reacting or pulp-reacting solution to a second GRIN lens (not shown) for light collection by a fiber optic cable 108.

Light absorption by the permanganate in the pulp-permangante solution takes place in the light pass between the two mirrors or prisms. The transmitted light contains the permanganate absorption information and is carried back to the spectrometer 42 by the second fiber optic cable 108. The absorption spectral signal is detected by the photometric array detector 42 on the spectrometer 42 and collected and displayed by the computer 40. In FIG. 2, the spectrometer is preferably spectrometer model CHEM2000-UV/Vis made by Ocean Optics, Inc. of Dunedin, Fla.

While FIGS. 1 and 2 illustrate embodiments consistent with the present invention, it is recognized by one skilled in the art that the present invention can utilize any suitable flow systems and filtration techniques to extract a pulp-reacting solution, or pulp-permanganate solution, for the purpose of analyzing time-dependent permanganate absorption using a detection device, such as the spectrophotometer.

For example, in an alternative embodiment of the present invention, the integrated absorption signal is used in the calculation of kappa number. A color band filter which filters the absorption of light below 450 nm and above 600 nm can be used. Specifically, the color band filter can then collect light in the desired visible region. Devices for collecting light in the desired region can include a low-pass filter for filtering light below 600 nm and a high-pass filter for filtering light above 450 nm, both of which are commonly known in the art. Consequently, any simple photo-detector suitable for detecting the integrated permanganate absorption over the entire absorption range of 450–600 nm to determine kappa number and any display device for displaying the integrated signal, such as a strip-chart recorder, an LED, and the like, can be used in the present invention. By replacing the spectrometer with the photo detector, the cost of the system is significantly reduced.

Theory of the Present Invention

Mathematically, the pulp kappa number is defined as $$K=p/w, \tag{2}$$

where K is kappa number, p is the amount of 0.02 mole/liter (0.1 N) potassium permanganate actually consumed by the pulp sample in mL, and w is the amount of O.D. pulp in grams.

In a pulp-permanganate oxidation reaction, the initial volume of 0.02 mole/liter (0.1 N) potassium permanganate added is a mL. Some of the potassium permanganate is consumed after adding w grams of pulp throughout the reaction. At the end of the pulp-permanganate oxidation reaction, also referred to herein as the oxidation reaction, the excess volume of 0.02 mole/liter potassium permanganate is b mL. Therefore, the consumed volume, p, of 0.02 mole/liter potassium permanganate can be expressed as $$p = a - b = a\left(1 - \frac{b}{a}\right). \tag{3}$$

The concentrations of potassium permanganate in the reacting solution at the beginning and the end of the oxidation reaction can be expressed as $$C_0 = \frac{0.02 \cdot a}{V_T} \tag{4}$$

and $$C_e = \frac{0.02 \cdot b}{V_T}, \tag{5}$$

respectively, where $V_T$ is the total volume of the reacting solution, which includes the addition of sulfuric acid. The reacting solution is also referred to herein as the mixture of potassium permanganate and sulfuric acid solution.

According to Beer's Law, absorption is proportional to the concentration of a sample, such that $$A_0=\epsilon \cdot l \cdot C_0 \tag{6}$$

and $$A_e=\epsilon \cdot l \cdot C_e, \tag{7}$$

where $A_0$ and $A_e$ are the permanganate absorbances (or spectral intensities) of the reacting solution in the beginning potassium permanganate blank solution and at the end of the oxidation reaction in the pulp-permanganate solution, respectively, $\epsilon$ and l are the mole absorptivity and the optical path-length of the flow cell, respectively.

Combining equations (4) to (7), renders $$\frac{b}{a} = \frac{A_e}{A_0}. \tag{8}$$

Substituting equation (8) into (3), the volume of potassium permanganate consumed in a pulp-permanganate solution can be expressed in terms of spectral intensities as follows:

$$p = a \cdot \left(1 - \frac{A_e}{A_0}\right) \tag{9}$$

As a result, the kappa number can be determined based on spectral intensities in accordance with the following expression:

$$K = \frac{a}{w}\left(1 - \frac{A_e}{A_0}\right), \tag{10}$$

where a and w are known quantities.

Consequently, absolute absorption measurements and quantitative calibration are unnecessary. Furthermore, the measurements in connection with the inventive system and method are much more reliable, accurate, and simplified than those measurements obtained in the well-known titration method.

Specifically, the kappa number equation (10) indicates that kappa number can be calculated from the ratio of the potassium permanganate absorption spectral intensities at a given wavelength measured in the beginning potassium-permanganate solution and at the end of the pulp-permanganate oxidation reaction in the pulp-permanganate solution. The given wavelength is preferably in the visible range of 450–600 nm, and more preferably in the range of 500–575 nm, and even more preferably at 546 nm.

The kappa number for a pulp sample can also be calculated using equation (10) with the spectral intensities $A_0$ and $A_e$ integrated over the entire permanganate absorption spectrum from 450 to 600 nm. Consequently, as previously mentioned, the present invention can include a simple photo detector for detecting the entire permanganate absorption spectrum to determine kappa number, instead of a diode array spectrometer 42 (FIGS. 1 and 2). Replacing the spectrometer with the photo detector significantly reduces the cost of the system.

Preparation of Reacting Solution

As previously mentioned, the reacting solution, also referred to herein as the potassium permanganate solution, consists mainly of water, potassium permanganate, and sulfuric acid, which makes the solution strongly acidic, preferably with initial $H^+$ concentration greater than 3.0 mole/L, and more preferably 3.2 mole/L. The concentration of each compound to produce the reacting solution includes standardized 0.02±0.0001 mole/L (0.1000±0.0005 N) potassium permanganate and about 2 mole/L sulfuric acid. The potassium permanganate is typically used to react with pulp samples under acidic conditions by adding the sulfuric acid. The volume ratio of the 0.02 mol/L potassium permanganate to the 2.0 mol/L sulfuric acid is preferably 1:4. The resulting sulfuric acid concentration in the mixed reacting solution is preferably 1.6 mol/L.

Pulp Kappa Number Measurement Process

The process for determining the pulp kappa number of a pulp sample is now described in accordance with the present invention. Distilled water can be used as a system calibrating solution for initial UV/Vis measurements. Next, predetermined amounts of potassium permanganate solution of concentration of 0.02 mole/liter and sulfuric acid of concentration of 2 mole/liter are poured into a container while stirring strongly. For example, 5 mL of potassium permanganate solution and 20 mL of sulfuric acid may be used to produce the reacting solution so long as the volume ratio of potassium permanganate to sulfuric acid is about 1:4. Mixing or stirring the reacting solution is performed typically using a stirring bar 10 and magnetic stirring meter 50 (FIG. 1) or by any other conventional manner commonly known in the art.

Referring to FIG. 1, the reacting solution then is circulated by the pump 30 through a flow loop including the feed line 25, flow cell 36, and light source 32 and a spectrophotometer 42 and 40.

Next, a predetermined amount of oven-dried or moisture-free pulp, which can vary preferably about 0.05 to 1000 grams depending on the size of the reacting solution, and more preferably from 0.05 to 0.15 gram, is added to the container 5 after the spectrophotometer 42 and 40 has started to take real-time data. It is recognized by those skilled in the art that a typical pulp consistency of less than 1% is recommended in the reacting solution. Time-dependent absorption spectra of the filtered pulp-permanganate solution 10 are recorded by the computer 42, such as a ChemStation, manufactured by Hewlett Packard (now Agilent Technologies) of Palo Alto, Calif. The spectra can be recorded for a predetermined time period, for example, five minutes, with a time interval of about one second. From this data, the pulp kappa number can then be determined using equation (10) previously described herein. It is understood by one skilled in the art that the amount of oven-dried, moisture-free, or wet pulp and the time period for which the data is taken are not limited to the above-described amounts and time, but may vary based upon standard practices.

Determination of the End of the Oxidation Reaction and Pulp Kappa Number

One problem associated with the prior art titration method for kappa number determination is that the pulp-permanganate oxidation reaction time is arbitrarily selected as ten minutes, irrespective of the reaction conditions, such as acidity, the species and the amount of pulp, and excess volume of permanganate used in the reactions.

In the present invention, the real-time absorption spectra are collected during the pulp-permanganate oxidation reaction in the pulp-permanganate solution. Consequently, time-dependent concentrations of the potassium permanganate can be obtained during the oxidation reaction in the pulp-permanganate solution.

Figure 3:
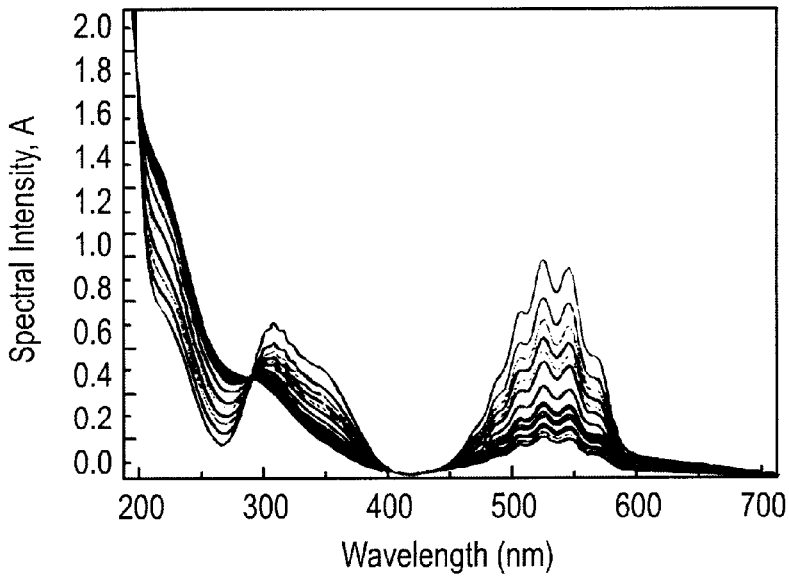
FIG. 3 is a graph illustrating a typical time-dependent UV/Visual absorption spectra of a pulp-reacting solution consistent with an embodiment of the present invention.

Referring to FIG. 3, typical UV/Vis absorption spectra of a pulp-potassium permanganate solution generated by a computer is illustrated consistent with the present invention. Each spectrum is a superposition of absorption from various chemicals in the reacting solution. Because lignin and other organic molecules do not have absorption in the middle and far visible range, in this example, the spectral intensity between 450–600 nm is purely the absorption of potassium permanganate. The typical relative standard deviation of a spectrophotometric measurement is only about 0.1%, which gives the negligible relative error in the ratio of the absorption spectral intensities in equation (10) of 0.1%.

With the time-dependent concentrations of potassium permanganate determined from the spectrophotometric measurements, the exact time of the pulp-permanganate oxidation reaction in the pulp-permanganate solution can be determined. According to Beer's Law, as set forth in equations (6) and (7), the permanganate concentration in the reacting solution is linearly proportional to the absorption spectral intensity A. This plot of time-dependent spectral intensity A is also referred to herein as a kinetic curve.

Figure 4:
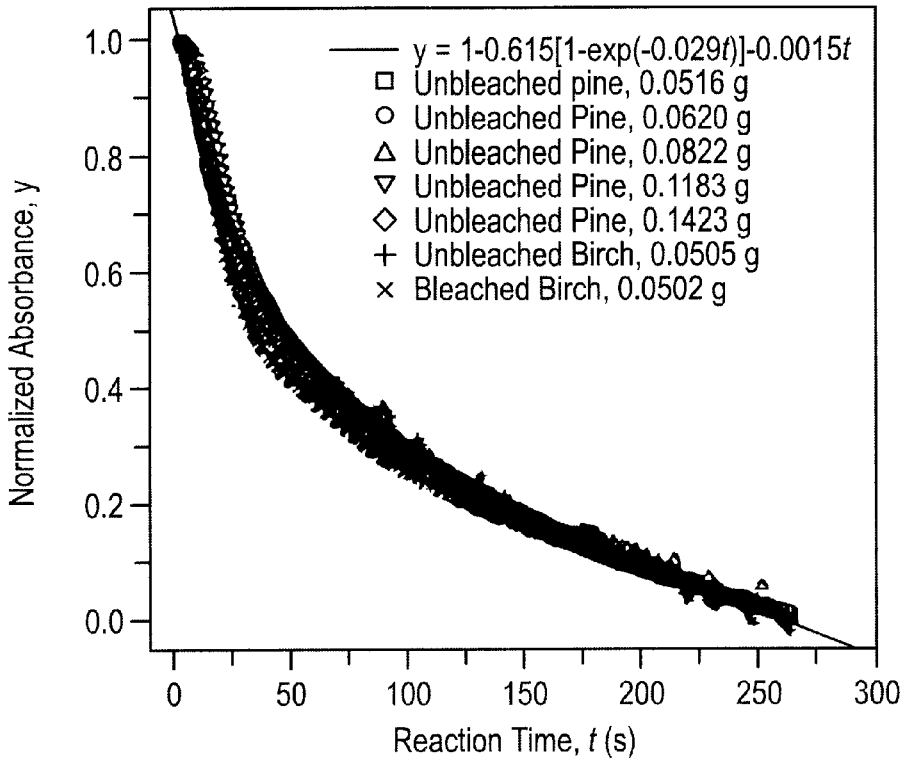
FIG. 4 is a graph illustrating a normalized time-depedent potassium permanganate ($KMnO_4$) absorption spectral intensity at 546 nm consistent with an embodiment of the present invention.

Observing the pulp-permanganate oxidation reaction kinetics using the time-dependent permanganate absorption integrated preferably over a selected permanganate absorption range between 450–600 nm, and preferably at a given wavelength 546 nm, it can be found that the kinetic curves from various oxidation reactions having different amounts of pulp and pulp species can be normalized onto a single curve, as shown in FIG. 4. Consequently, this finding indicates that the normalized oxidation reaction rate, for example, the potassium permanganate consumption per gram of pulp, does not change with the absolute amount of excess permanganate or pulp and pulp species used.

Figure 5:
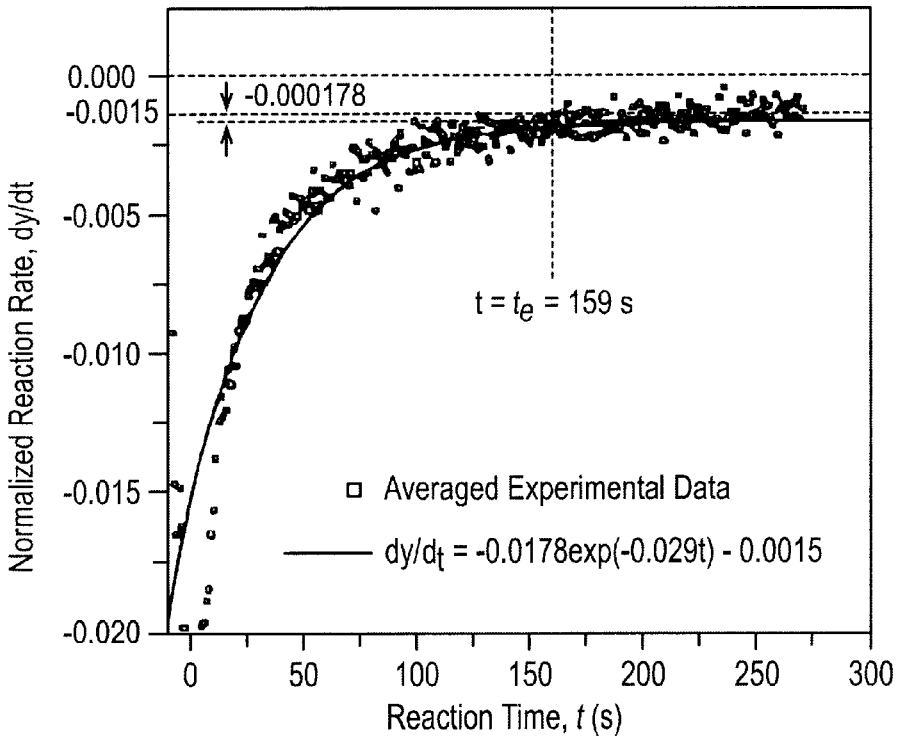
FIG. 5 is a graph illustrating a time derivative of the normalized potassium permanganate ($KMnO_4$) absorption spectral intensity at 546 nm consistent with an embodiment of the present invention.

Based on the graphical data presented in FIG. 4, the time derivative of the normalized permanganate absorption or concentration, or the oxidation reaction rate of the pulp-permanganate oxidation reaction, can then be determined. FIG. 5 illustrates the normalized oxidation reaction rates averaged over the samples of various pulps and pulp species of FIG. 4.

As previously described, there are generally two main reactions occurring simultaneously in a pulp-permanganate solution, that is, the rapid oxidation by potassium permanganate and the slow decomposition of potassium permanganate by other organic materials. The permanganate oxidation is carried out in strong acidic conditions, typically having initial $H^+$ concentration preferably greater than 3 mol/L, and more preferably at 3.2 mol/L, to significantly reduce or eliminate the effect of the amount of pulp or excess permanganate on measured kappa number, and to prevent the precipitation of $MnO_2$. As previously mentioned, the precipitation of $MnO_2$ can cause measurement difficulties due to the interference of the permanganate spectrum by the $MnO_2$ and in quantifying the amount of $MnO_2$ formed.

The reaction activation energies of these two reactions are different in that pulp can be easily oxidized by potassium permanganate, while the decomposition reactions between potassium permanganate and other organic materials dominate only after the oxidation reaction is complete. The pulp-permanganate oxidation reaction can be expressed in a two-rate (exponential and linear decay) equation model as follows, $$y=1.0-m[1-\exp(-Et)]-Bt, \tag{11}$$

where for example, in FIG. 4, m=0.615, E=0.029, B=0.0015, y is the non-dimensional permanganate absorption at 546 nm, and t is the oxidation reaction time in seconds. The pulp-permanganate oxidation reaction time is determined kinetically by directly examining the oxidation reaction rate. In the examples to follow, the oxidation reaction rate was determined from the time-dependent permanganate absorption spectra.

In this two-rate model, the exponential and the linear decay function represent the permanganate consumption by rapid oxidation of the pulp early in the pulp-permanganate oxidation reaction and the slow decomposition reaction by other organic materials, respectively. Equation (11) clearly indicates that the exponential decay function is important only during the initial short time period, small t, while the linear decay function dominates later in the oxidation reaction, longer time t, as previously mentioned. The normalized oxidation reaction rate can be determined by taking the time derivative of equation (11), where the normalized oxidation reaction rate is then expressed as follows, $$\frac{dy}{dt} = -m \cdot E \exp(-Et) - B \tag{12}$$

The purpose of this analysis is to determine the oxidation reaction time when the oxidation (lignin oxidation in particular) ends $t_e$, so that the permanganate absorption $A_e$ at time $t_e$ can be determined from FIG. 4. Once the permanganate absorption $A_e$ is determined, the pulp kappa number then can be ascertained using equation (10).

If the reaction energies of the two permanganate reactions differ significantly, a clear breaking point in the curves of the permanganate consumption and the oxidation reaction rate can be observed in FIGS. 3 and 4. In this case, however, such breaking point is not present in the reaction systems of FIGS. 3 and 4, where each is represented by the solid lines of equations (11) and (12), respectively. As a result of the asymptotic nature of the oxidation reaction rate curve, the end of the oxidation reaction is defined as the point at which the oxidation reaction rate (the exponential decay function part of equation (12)) is reduced to only q % of its maximum rate (at t=0, or m·E=0.0178 according to equation (12)). Mathematically, $t_e$ can be defined as $$\left.\frac{dy}{dt}\right|_{t=t_e} = -m \cdot E\frac{q}{100} - B = [-m \cdot E \exp(-Et_e)] - B, \tag{13}$$

such that $$t_e = -\frac{\ln(q/100)}{E} = -\frac{\ln(q/100)}{0.029}. \tag{14}$$

In the examples presented herein below, setting q=1 is considered the same as defining the thickness of a boundary layer of a flow over a solid surface in fluid mechanics for engineering simplification. For a given temperature of 25° C. with strong acidification, in these examples, the oxidation reaction end point $t_e$ is a constant and is equal to 159 seconds, where each pulp sample varied in amounts of pulp, pulp species, and final excess permanganate volume. This oxidation reaction time of 159 seconds is much shorter than the ten minutes required in the prior art Tappi test method, as well as other times recommended in the art.

While the absorption spectroscopic method used in accordance with the present invention is a direct permanganate spectroscopic kappa test method, it is understood that the permanganate volume consumed in a reaction can be determined using any absorption spectroscopic method for quantitative analysis, such as a peak ratio method or an absolute analysis through calibration, both of which are commonly known in the art.

EXAMPLES

The following examples demonstrate the accuracy of determining the pulp kappa number using the system and method consistent with the present invention and are merely illustrative of the present invention.

Example 1

Effect of Determining the End of Reaction on Pulp Kappa Number

To demonstrate the effect of the inventive process for determining the oxidation reaction end point $t_e$ on measured kappa number, the kappa numbers of three different pulp samples were determined from the measured spectral intensity data using different q or oxidation reaction end point $t_e$. The experiments were conducted at room temperature T=25° C.

Figure 6:
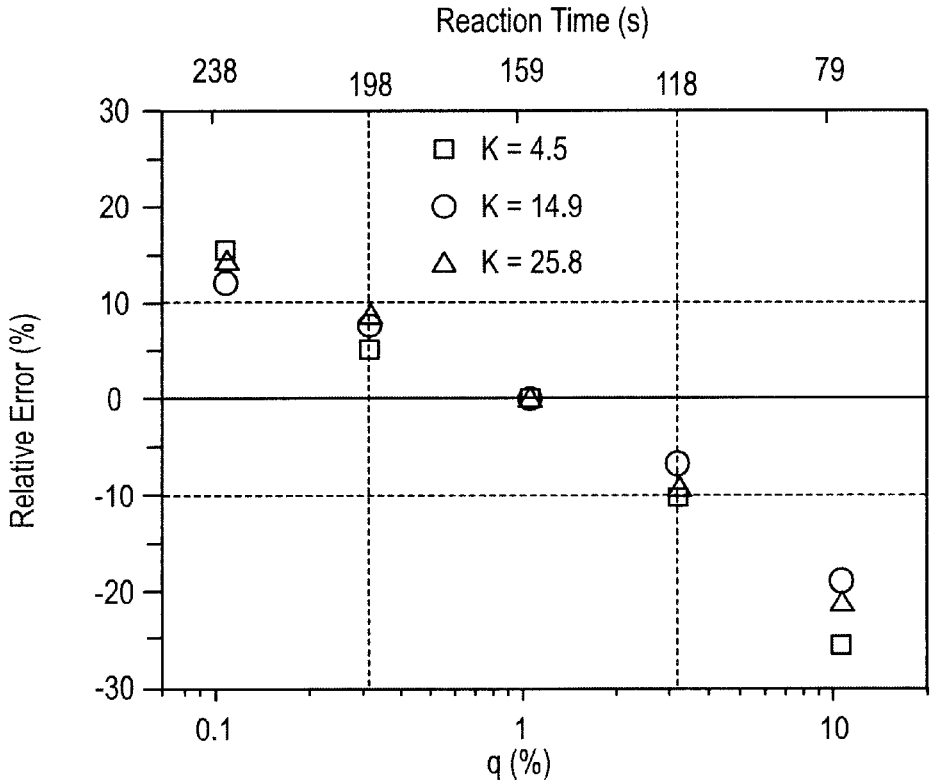
FIG. 6 is a graph illustrating the effect of parameter q on measurement uncertainty consistent with an embodiment of the present invention.

It was found that the relative differences in measured kappa numbers of these three pulp samples (based on q=1) were less than 10% for q, varying from 0.32 to 3.3 (more than an order of magnitude variation), corresponding to an effective oxidation reaction end point $t_e$ varying from 198 to 118 seconds (about 70% variation), as listed in Table I and shown in FIG. 6. This calculation demonstrates the accuracy and validity of the inventive method in determining the end of the oxidation reaction.

After determining the oxidation reaction end point, the excess permanganate absorption at the end of oxidation reaction can be determined from the spectra collected. Consequently, the kappa number can be calculated from equation (10) using the absorption data.

TABLE I

Effect of Parameter q on the Relative Measurement Uncertainty of the Inventive Method

| | Lignin Oxidation | Relative Measurement Uncertainty (%) | | |
|---|---|---|---|---|
| q (%) | Reaction Time, $t_e$ (s) | K = 4.5 | K = 14.9 | K = 25.8 |
| 0.1 | 238 | 15.4 | 12.1 | 14.3 |
| 0.3 | 198 | 5.12 | 7.6 | 8.4 |
| 1.1 | 159 | 0 | 0 | 0 |
| 3.3 | 118 | −10.3 | −6.8 | −9.3 |
| 10.7 | 79 | −25.6 | −18.9 | −21.1 |

Example 2

Effect of Amount of Pulp Used on Measured Kappa Number

One of the problems of the existing titration method for measuring the kappa number is that for a given pulp sample, the measured kappa number varies based on the amount of pulp sample used or the excess volume of the permanganate solution used. However, with strong acidification, this effect on kappa number is diminished as described in an article by Valeur and Tomgren, entitled "A Proposed Method for Determining the Permanganate Number of Pulp," *Svensk Papperstidning*, 30(22):829 (1957), which is incorporated herein by reference in its entirety.

In the present invention, the variation in measured kappa number was eliminated using strong acidification and the oxidation reaction end point was determined using the inventive process. In this example, pine pulp of sample size from 50 mg to 150 mg was used to test the effect of the amount of pulp sample used or the excess permanganate on the measured kappa number. It was found that the measured kappa number of the pulp sample using the present invention based on Equation (10) did not change with the amount of pulp sample used. The results are listed in Table II.

In Table II, the mean kappa number was 25.8 with a relative standard deviation of only 2.3%. Compared with the measured kappa number of 25.4 using the traditional titration method, the difference is only 1.6%. It was also found that the measured volume of the permanganate consumed is linearly proportional to the amount of pulp sample used in the experiments because the same pulp sample was used. Furthermore, the oxidation reaction time was reduced to only 2.65 minutes because of the strong acidification.

TABLE II

Measured Kappa Number Using Different Amounts of Pulp Sample

| No. | Pulp Mass (g) | $A_0$ | $A_e$ | KMnO4 Consumed (mL) | Measured Kappa No. |
|---|---|---|---|---|---|
| 1 | 0.0516 | 0.922 | 0.682 | 1.302 | 25.2 |
| 2 | 0.0620 | 0.921 | 0.619 | 1.636 | 26.4 |
| 3 | 0.0832 | 0.922 | 0.519 | 2.217 | 26.3 |
| 4 | 0.1183 | 0.920 | 0.356 | 3.071 | 25.9 |
| 5 | 0.1403 | 0.919 | 0.272 | 3.515 | 25.1 |
| Mean | | | | | 25.8 |
| RSD | | | | | 2.3% |

Example 3

Effect of Pulp Type on Measured Kappa Number

To demonstrate the consistency between the kappa measurements using the present invention and the prior art titration method, three pulp samples derived from two wood species (pine and birch) were measured with and without bleaching with significant variation in kappa numbers (from 4 to 26). The measured kappa numbers of the three pulp samples were approximately the same using the two methods. The maximum relative difference in kappa numbers between these two methods was less than 5% at low kappa numbers as shown in Table III.

TABLE III

Comparison of Measured Kappa Number Using Present Method with Those Obtained Using the Titration Method

| | | | Measured Kappa Number | | |
|---|---|---|---|---|---|
| No. | Pulp | Pulp Mass (g) | Present Method | TAPPI Tes Titration Method (1996) | Relative Difference (%) |
| 1 | birch, bleached | 0.0501 | 4.5 | 4.3 | 4.5 |
| 2 | birch, unbleache | 0.0505 | 14.9 | 15.3 | −2.6 |
| 3 | pine, unbleached | 0.0516 | 25.8 | 25.4 | 1.6 |

Although the existing titration method has several problems as previously described and the measurement results of a same pulp sample are dependent on the skill of the operator, the titration method has been widely accepted by the pulp and paper industry as well as the academic communities throughout the world. From a practical application point of view, the pulp and paper industry will benefit from any new kappa determination method that can give rapid, consistent results as compared with the existing method.

In summary, the present invention uses spectrophotometry to accurately determine the permanganate oxidation reaction time and the excess volume of permanganate in a reacting solution. The present invention uses strong acidification to prevent the precipitation of manganese dioxide ($MnO_2$), which can cause spectral interference. Consequently, the present invention eliminates spectral interference and reaction (1a) becomes the dominating oxidation reaction. The present invention also eliminates the effect of the final volume of excess potassium permanganate and the mass of the pulp sample on measuring the kappa number.

Advantageously, the present invention rapidly, accurately, and directly determines pulp kappa numbers of various pulp samples using permanganate absorption data without the need for calibration, corrections or use of tedious titration experiments. Moreover, the element of human error is eliminated due to reliance on spectrophotometry for measuring kappa.

Alternative embodiments will become apparent to those skilled in the art to which the present invention pertains without departing from its spirit and scope. Accordingly, the scope of the present invention is defined by the appended claims rather than the foregoing description.

What is claimed is:

1. A method for determining a pulp kappa number for a pulp sample, comprising the steps of:

(a) mixing continuously a pulp-reacting solution, said pulp-reacting solution comprising: 1) a predetermined amount of pulp containing fibers and 2) a predetermined amount of reacting solution, said reacting solution having strong acidification and including an oxidation agent, where mixing the pulp-reacting solution causes an oxidation reaction in the pulp-reacting solution, and where the strong acidification of the reacting solution has an H+ concentration that limits the production of precipitated $MnO_2$ such that precipitated $MnO_2$ is insignificant;

(b) filtering the pulp-reacting solution to limit fiber flow;

(c) subjecting at least a segment of the fiber filtered pulp-reacting solution to light, wherein the light is partially absorbed by the oxidation agent in the pulp-reacting solution;

(d) generating a time-dependent absorption spectral intensity from the absorption of the light by the oxidation agent in the pulp-reacting solution;

(e) collecting the time-dependent absorption spectral intensity by an absorption spectrographic method to determine an absorption spectral intensity for the oxidation agent;

(f) analyzing the time-dependent absorption spectral intensity using an oxidation reaction kinetic analysis to determine an oxidation reaction end point; and (g) calculating a pulp kappa number for the pulp sample based on the predetermined amount of pulp, the predetermined amount of reacting solution, the absorption spectral intensity of the oxidation agent before the oxidation reaction, and the absorption spectral intensity of the oxidation agent at the oxidation reaction end point.

2. The method of claim 1, wherein the pulp-reacting solution is subjected to light by an optical flow cell, said optical flow cell being capable of transmitting visible light.

3. The method of claim 1, wherein the pulp-reacting solution is subjected to light by a fiber optic probe, said fiber optic probe being capable of transmitting and redirecting visible light.

4. The method of claim 1, wherein the predetermined amount of pulp ranges from about 0.05 to 1000 grams.

5. The method of claim 1, wherein the oxidation agent is potassium permanganate ($KMnO_4$).

6. The method of claim 5, wherein the reacting solution having strong acidification contains sulfuric acid, where the sulfuric acid has a concentration level sufficient to prevent a significant amount of $MnO_2$ from being precipitated during the oxidation reaction.

7. The method of claim 1, wherein the reacting solution comprises the oxidation agent being 0.02 mol/L potassium permanganate solution and the strong acidification being 2.0 mol/L sulphuric acid, where the volume ratio of 0.02 mol/L potassium permanganate solution and 2.0 mol/L sulphuric acid is 1:4.

8. The method of claim 7, wherein the resulting sulfuric acid concentration in the pulp-reacting solution is about 1.6 mol/L.

9. The method of claim 1, wherein the strong acidification of the reacting solution has an initial H+ concentration in the range of about 3.0 mol/L to 10 mol/L.

10. The method of claim 1, wherein the absorption spectroscopic method uses the absorption spectral intensity of the oxidation agent at any selected wavelength between 450–600 nm.

11. The method of claim 1, wherein the absorption spectroscopic method uses the absorption spectral intensity of the oxidation agent integrated over the entire absorption range of 450–600 nm.

12. The method of claim 1, wherein the kappa number is calculated based on the equation, $$K = \frac{a}{w}\left(1 - \frac{A_e}{A_0}\right),$$

where K is the kappa number, a is the predetermined amount of reacting solution having strong acidification, w is the predetermined amount of pulp, $A_0$ is the oxidation agent absorption before the oxidation reaction, and $A_e$ is the oxidation agent absorption spectral intensity at the oxidation reaction end point.

13. The method of claim 12, wherein $A_0$ is determined by obtaining the oxidation agent absorption in the reacting solution before performing the step (a).

* * * * *